US006030318A

United States Patent [19]

Howard

[11] Patent Number: 6,030,318

[45] Date of Patent: Feb. 29, 2000

[54] METHOD AND SYSTEM FOR PASSIVELY EXERCISING SELECTED PORTIONS OF A HUMAN BODY

[76] Inventor: Kenneth W. Howard, Rte. 1 Box 151-B, DeKalb, Tex. 75559

[21] Appl. No.: 09/086,549

[22] Filed: May 28, 1998

[51] Int. Cl.[7] ..... A61H 9/00

[52] U.S. Cl. ..... 482/4; 601/6

[58] Field of Search ..... 601/1, 6, 7–11, 601/76, 84, 148, 151; 604/74; 482/4

[56] References Cited

U.S. PATENT DOCUMENTS 4,754,748 7/1988 Antowski .
4,836,192 6/1989 Abbate .
5,514,079 5/1996 Dillon .
5,520,613 5/1996 Copelan ..... 601/14
5,562,604 10/1996 Yablon et al. .
5,571,084 11/1996 Palmer .
5,674,262 10/1997 Tumey .

*Primary Examiner*—Glenn E. Richman
*Attorney, Agent, or Firm*—Carr & Storm, L.L.P.; Jack D. Stone, Jr.

[57] ABSTRACT

A method and system for passively exercising a selected portion of a human body by applying a partial vacuum pressure to the selected portion of the human body; maintaining the partial vacuum pressure applied to the selected portion of the human body for a first predetermined period of time; releasing the partial vacuum pressure so that substantially atmospheric pressure is applied to the selected portion of the human body; and maintaining the substantially atmospheric pressure applied to the selected portion of the human body for a second predetermined period of time.

27 Claims, 5 Drawing Sheets

METHOD AND SYSTEM FOR PASSIVELY EXERCISING SELECTED PORTIONS OF A HUMAN BODY

FIELD OF THE INVENTION

The invention relates generally to a method and system for passively exercising a selected portion of a human body and, more particularly, to such a method and system wherein a vacuum pressure is cyclically applied to the selected portion of the human body to stimulate circulation of blood through the selected portion.

BACKGROUND OF THE INVENTION

Many procedures and techniques are available to aid people in acquiring the physical appearance they desire and to provide people with certain therapeutic effects they need for their bodies. For example, it is often desirable to remove excess fat from a body. One way to do remove excess fat is by dieting and exercising. Diet and exercise, however, require much self-discipline and are difficult to sustain over long periods of time. Alternatively, excess fat may be removed surgically through liposuction. Liposuction, however, is very expensive and commonly leaves a person in pain and with bruises.

In another example, women often desire to enhance the size of their breasts. Typically, this is also done using surgical procedures, namely, through silicon implants. Silicon implants, however, have uncertain and potentially dangerous side effects and therefore risky. They are, furthermore, prohibitively expensive for many women.

In still further examples, medicine, surgery, chiropractic therapy, and/or massage therapy is commonly used to remedy other ailments such as sores, wrinkles, back pain, infantilism (e.g., unemerged testicles), and urological problems. Such remedies, however, are invasive, expensive, of questionable value, and/or leave scars.

Accordingly, a continuing search has been directed to the development of methods and systems which can reduce fat without diet, exercise, or surgery, which can enhance the size of breasts without silicon implants, and which can enhance or therapeutically heal other portions of a body without expensive medicine, surgery, or chiropractic or massage therapy.

SUMMARY OF THE INVENTION

According to the present invention, it has been found that fat may be removed, and that selected portions of the body may be enhanced and/or healed by applying a partial vacuum pressure to the selected portion of the human body; maintaining the partial vacuum pressure applied to the selected portion of the human body for a first predetermined period of time; releasing the partial vacuum pressure so that substantially atmospheric pressure is applied to the selected portion of the human body; and maintaining the substantially atmospheric pressure applied to the selected portion of the human body for a second predetermined period of time.

The present invention also provides for a system for passively exercising a selected portion of a human body, wherein the system is comprised of a pump configured for generating a partial vacuum pressure; a first valve connected in fluid communication with an output of the pump; a second valve in fluid communication with atmospheric pressure; a sealing device configured for providing a pressure seal over the selected portion of the human body, the sealing device being connected in fluid communication with the first valve so that when the first valve is open, fluid communication is established between the sealing device and the output of the pump, the sealing device being connected in fluid communication with the second valve so that when the second valve is open, fluid communication is established between the sealing device and atmospheric pressure; and a controller configured for controlling the opening and closing of the first valve and the second valve in response to signals received from a computer.

DESCRIPTION OF THE PREFERRED EMBODIMENTS

Figure 1:
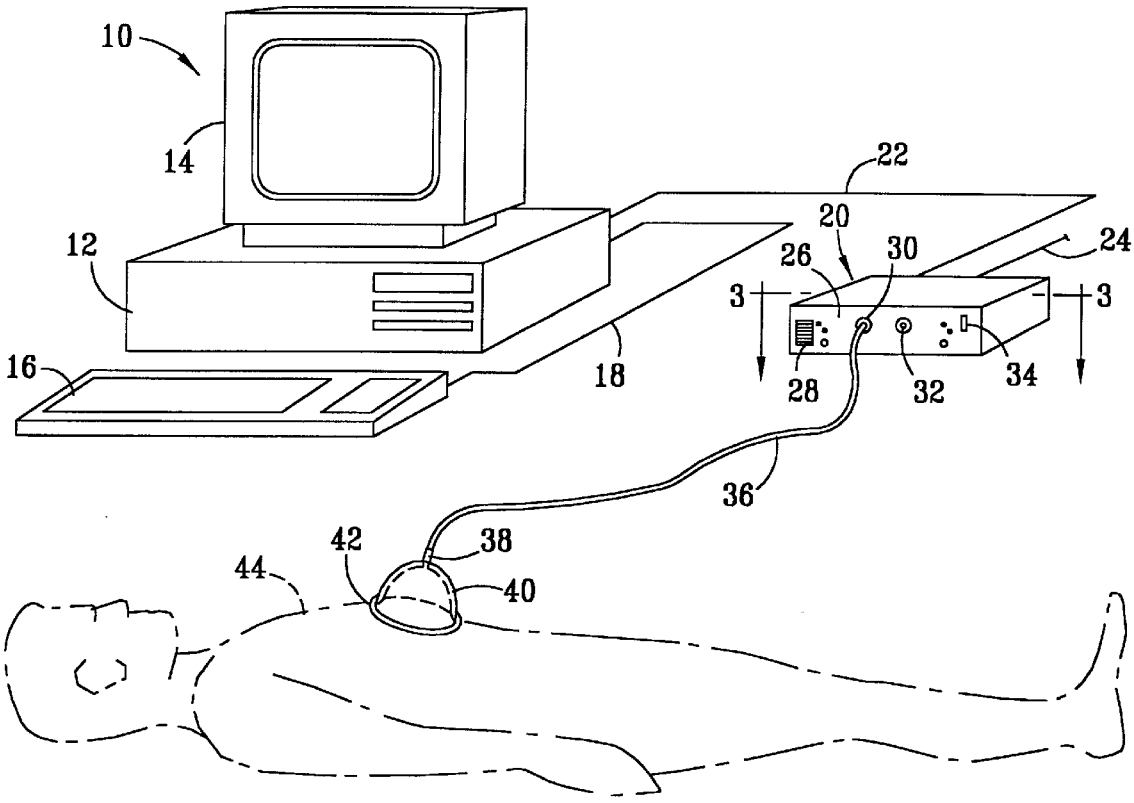
FIG. 1 is a perspective view of an embodiment of the present invention being used to passively exercise a selected portion of a human body.

In the discussion of the Figures, the same reference numerals will be used throughout to refer to the same or similar components. In the interest of conciseness, various components known to the art, such as valves, tubing, computer components, and the like necessary for the operation, control, and utilization of the present invention, have not been shown or discussed in detail.

Referring to FIG. 1 of the drawings, the reference numeral 10 generally designates a passive exercise system embodying features of the present invention. The system 10 includes a digital computer 12, well known in the art, having a monitor 14 connected to the computer, and a keyboard 16 connected to the computer via a suitable cable 18. While not shown, the computer 12 also includes a memory for storing control logic, described below with reference to FIG. 5, and appropriate signal generator circuitry for generating control signals, also described below. A vacuum pressure generator unit 20 is connected to the computer 12 via a suitable cable 22 for transmitting the control signals generated from the computer to the vacuum pressure generator unit 20. The generator unit 20 also includes a power cord 24 for receiving operating power from a conventional power supply, such as an AC (alternating current) plug outlet.

The vacuum pressure generator unit 20 defines a frontal portion 26 having a vent 28 for permitting air to flow into the generator unit, a vacuum outlet 30, a pressure inlet 32, and a power switch 34 operable for activating power to the generator unit. A pneumatic tube 36 is connected between the vacuum outlet 30 and a nipple 38 of a sealing device 40, described below, for providing fluid communication between the vacuum outlet 30 and the sealing device 40. As shown in FIG. 1, the pressure inlet 32 is configured for receiving atmospheric air. As described below with respect to an alternate embodiment depicted in FIG. 6, a tube may be attached to the pressure inlet 32 to permit the inlet 32 to receive alternate fluids such as oxygen.

Figure 2A:
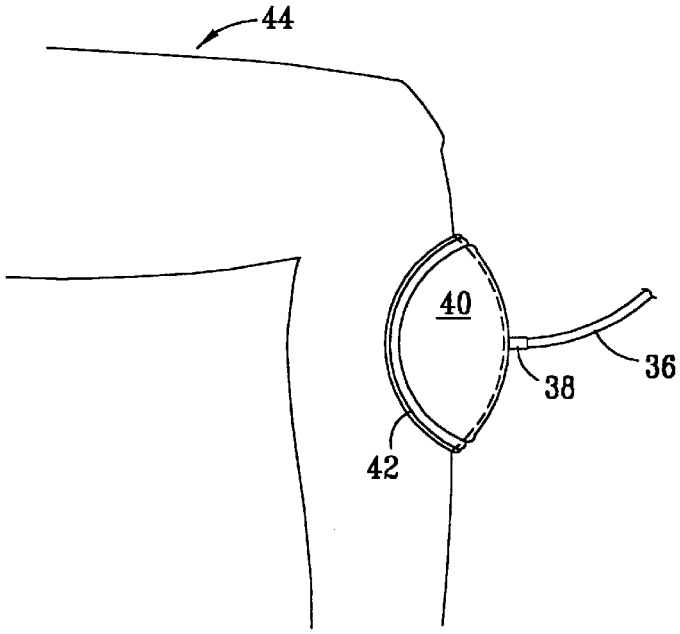
FIGS. 2A–2G show alternative embodiments of sealing devices that may be used with the system of FIG. 1.
Figure 2B:
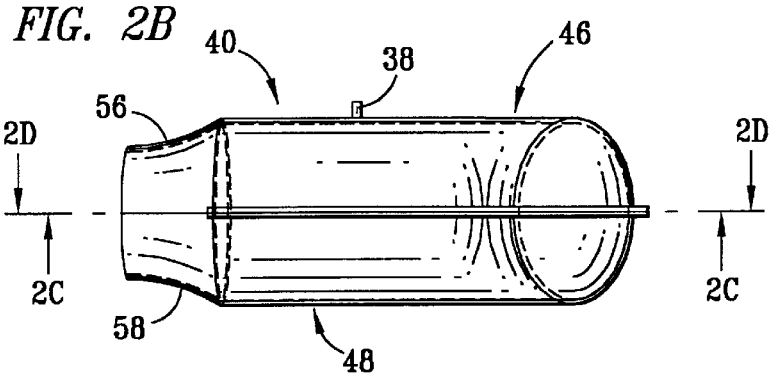
Figure 2C:
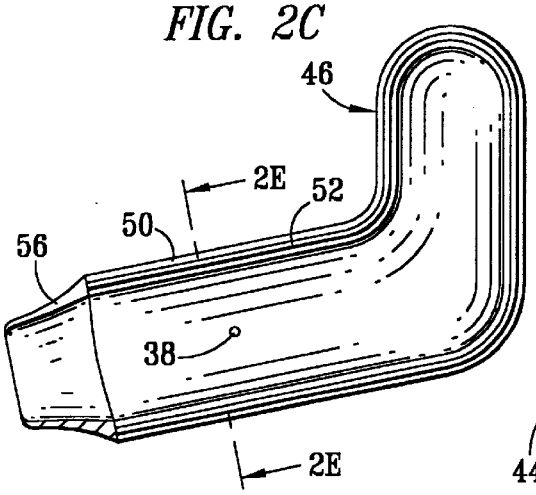
Figure 2C:
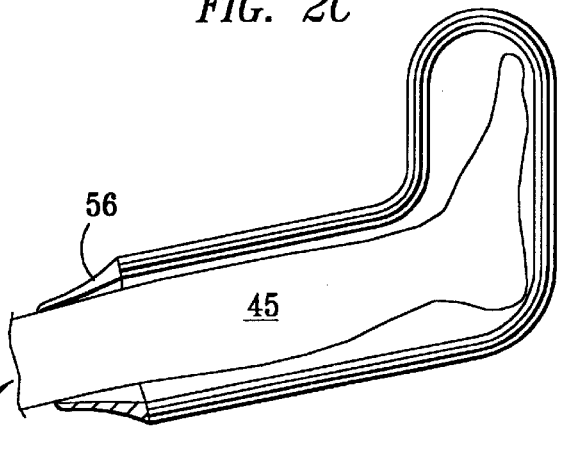
Figure 2D:
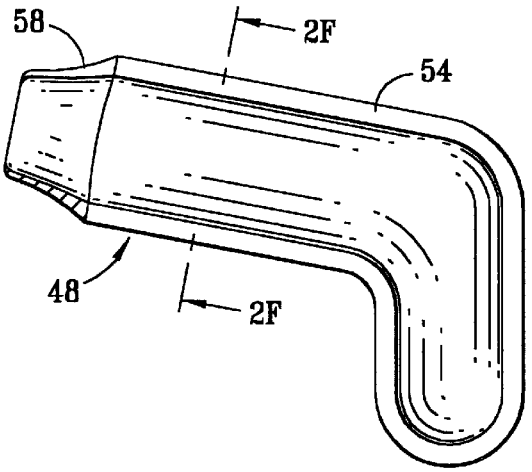
Figure 2F:
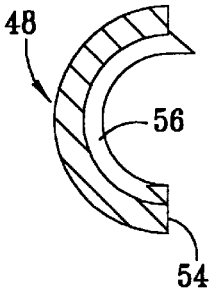
Figure 2E:
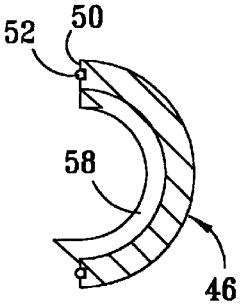
Figure 2G:
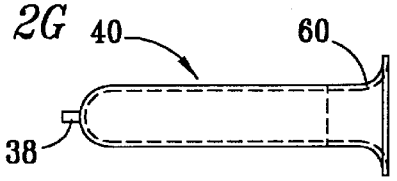

The sealing device 40 preferably comprises a single piece of material such as polyethylene or the like having sufficient structural integrity to withstand a partial vacuum pressure of up to 40 kilo paschals, hereinafter "kPa," wherein 1 kPa is equal to approximately 1% of atmospheric pressure at sea level on a standard day. The nipple 38 and a flange portion 42 of the sealing device 40 are preferably formed as integral portions of the single piece of material from which the sealing device 40 is comprised; the nipple and flange portion may optionally be discrete elements secured to the sealing device. The flange portion 42 is sized and configured for sealingly conforming to and engaging skin surrounding a selected portion of a human body 44, as exemplified in FIG. 1, which selected portion may be circular, oval, square, rectangular, or the like. The sealing device 40 is shown as having a generally semi-spherical dome shape, but may be configured in any of a number of different configurations, such as a tubular shape, a clam-shell shape, or the like. Such configurations of the flange portion 42 and of the sealing device 40 are considered to be obvious and desirable by those skilled in the art based upon a review of the present description of a preferred embodiment for providing a seal about any selected portion of a human body, such as fatty tissue, muscle tissue, a breast, a penis, a portion of a leg, a foot, a portion of an arm, a hand, a portion of a back, a healing portion of skin, a wrinkled portion of skin, or the like. For example, FIG. 2A shows a sealing device 40 configured for providing a seal to a curved skin surface such as a portion of a leg or an arm. FIG. 2B depicts a top view of an alternate embodiment of the sealing device 40 for enclosing a protruding body part such as an entire foot and lower portion of a leg, the sealing device having first and second portions 46 and 48 positioned together, which portions may be secured together as so positioned using tape (not shown). The nipple 38 is positioned on the first portion 46 for providing fluid communication between the vacuum outlet 30 and the sealing device 40. As shown in FIGS. 2C and 2E, the first portion 46 defines an edge 50 having a groove formed therein for receiving a gasket 52. As shown in FIGS. 2D and 2F, the second portion 48 defines a flat edge 54 for engaging and compressing the gasket 52 when the portions 46 and 48 are secured together as shown in FIG. 2B to thereby maintain a seal between the portions 46 and 48. As shown in FIGS. 2B–2D, pliable sealing lips 56 and 58 extend from the portions 46 and 48, respectively, and curve inwardly for providing a seal between the sealing device 40 and the user's leg. As shown more clearly in FIGS. 2E and 2F, the sealing lips 56 and 58 are configured to sealingly overlap each other. FIG. 2C' exemplifies how the sealing device 40 of FIGS. 2B–2F may be fitted for operation over a foot and lower leg portion 45 of a user. In yet another alternate embodiment of the sealing device 40, FIG. 2G depicts an elongated sealing device having a cylindrical cross-section (not shown) sized for sealing off a penis (not shown). The sealing device depicted in FIG. 2G includes a pliable base portion 60 for sealingly conforming to the base of a penis and scrotum.

Figure 3:
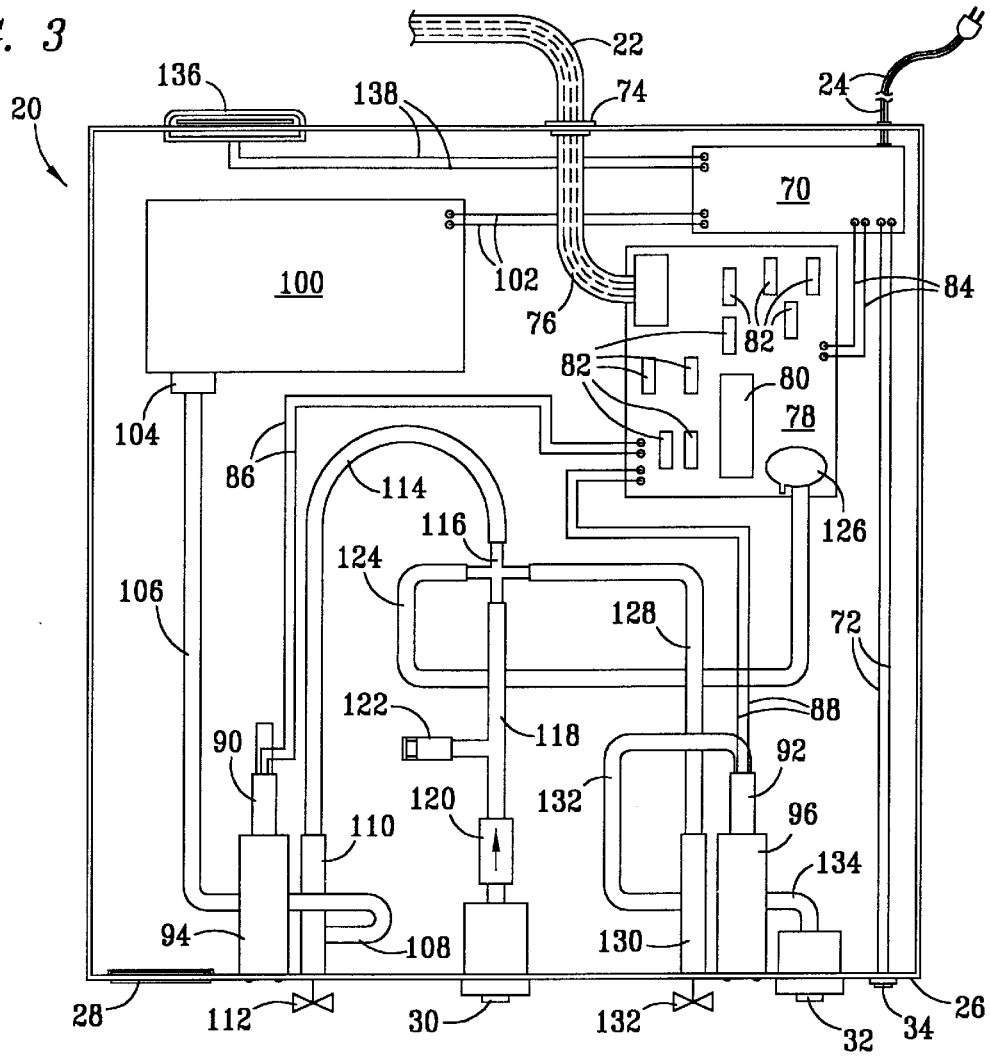
FIG. 3 is a plan view of the interior of a vacuum pressure generator unit taken along the line 3—3 of FIG. 1.

FIG. 3 shows a plan view of the interior of the vacuum pressure generator unit 20 taken along the line 3—3 of FIG. 1. The power cord 24 is connected for supplying power to a power supply 70 mounted in the vacuum pressure generator unit 20, and lines 72 are connected between the power supply 70 and the power switch 34 for activating and deactivating the power supply 70. The cable 22 is connected to a connector 74 for carrying signals from the cable 22 through a cable 76 to a controller circuit board 78. Attached to the circuit board 78 are a microprocessor 80 and appropriate resistors, transistors, capacitors, semi-conductors, and other circuit elements arranged and interconnected for providing control logic adapted for performing functions, described in greater detail below, required for the operation of the vacuum pressure generator unit 20 in response to signals received from the computer 12. Because the implementation details of the circuit board 78 will be apparent to a skilled artisan based upon a review of the present description of the invention, the circuit board 78 will not be described in further detail herein. The circuit board 78 is connected via lines 84 for receiving electrical operating power from the power supply 70, and via output lines 86 and 88 for carrying control signals to first and second actuators 90 and 92, respectively, which are adapted to open or close first and second valves 94 and 96, respectively. The actuators 90 and 92 may be any device operable to open and close valves, such devices as solenoids, motors in combination with gear mechanisms, or the like, well known to those skilled in the art. Each of the valves 94 and 96 may be any suitable valve, such as a gate valve or the like, which may be readily opened or closed by operation of the actuators 90 and 92.

A vacuum pressure pump 100 is mounted in the vacuum pressure generator unit 20 and is connected via lines 102 for receiving electrical operating power from the power supply 70. The pump 100 may be any suitable electrically-powered pump preferably having at least 0.05 horsepower and capable of pulling a partial vacuum of at least 50 kPa. Such vacuum pumps are considered to be well known to those skilled in the art and will therefore not be discussed further. The pump 100 includes a vacuum outlet connector 104 connected in fluid communication via a tube 106 to an inlet on the first valve 94. An outlet of the first valve 94 is connected in fluid communication through a tube 108 to an inlet of an optional third valve 110 having a valve stem 112 extending through the frontal portion 26 of the vacuum pressure generator unit 20, and from an outlet of the third valve 110 through a tube 114 to a cross 116. The cross 116 is connected in fluid communication through a tube 118 and a filter 120 to the vacuum outlet 30. The filter 80 is suitably configured and positioned in the line 118 for permitting gas such as air or oxygen to flow freely therethrough and for preventing particles such as flakes of skin and the like from passing through the line 118 and entering the third valve 110, the first valve 94, and the pump 100. A suitable safety pressure relief valve 122 is positioned on the line 118 for preventing a vacuum pressure greater than a predetermined vacuum, such as 30 kPa, from being applied through the sealing device 40 (FIGS. 1–2B). The cross 116 is also connected in fluid communication through a tube 124 to a pressure sensor 126 mounted on the circuit board 78 and configured and connected for generating to the microprocessor 80 a signal indicative of the pressure in the tube 124, which pressure will be substantially the same as the pressure at the vacuum outlet 30. Additionally, the cross 116 is connected in fluid communication via a tube 128 to an optional fourth valve 130 having a valve stem 132 extending through the frontal portion 26 of the vacuum pressure generator unit 20, and from the fourth valve 130 through a tube 132 to the second valve 96, and from the second valve 96 through a tube 134 to the pressure inlet 32. Each of the third and fourth valves 110 and 130, respectively, may be a ball valve or the like which may be continuously operated in a partially open state so that the rate of fluid flowing therethrough may be regulated in a manner described below.

The vacuum pressure generator unit 20 further includes an electrically-powered fan 136 positioned in a rear opening of the box. The fan 136 is connected via lines 138 for receiving electrical power from the power supply 70 and, upon receiving such power, for causing air to flow through the vent 28 across components in the generator unit 20, to thereby cool such components, and to then flow through the fan 136 out of the generator unit 20.

Figure 4:
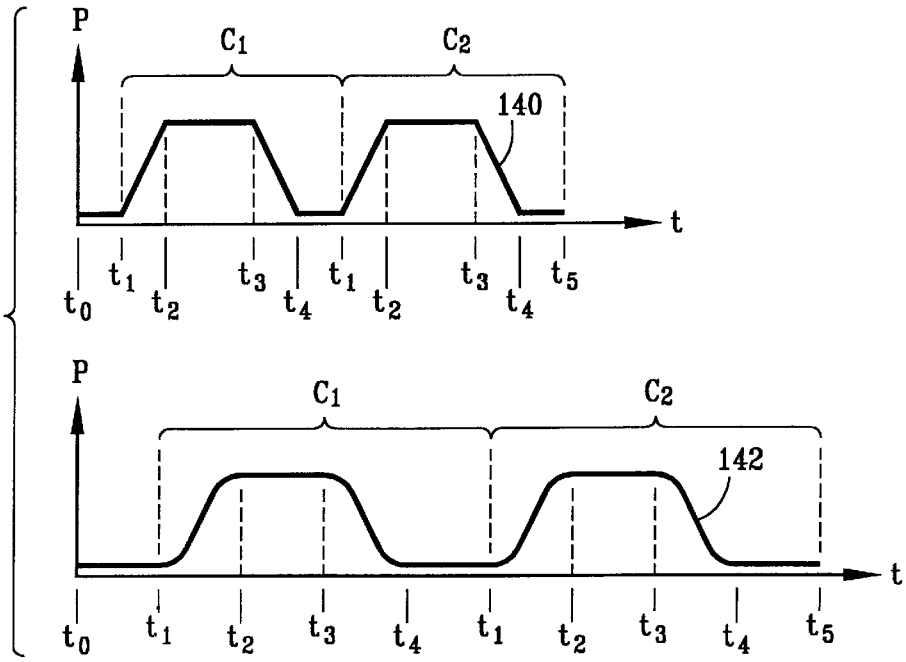
FIG. 4 shows two waveforms depicting pressure generated by the present invention over a period of time.

FIG. 4 depicts two pressure-time curves 140 and 142 plotted on a vertical ("P") axis which represents the pressure sensed by the pressure sensor 126 and applied in the sealing device 40, and the horizontal ("t") axis which represents the time at which the pressure is measured. A plurality of variables, $t_0$, $t_1$, $t_2$, $t_3$, $t_4$, and $t_5$, are used by the computer 12 as discussed below, and are depicted as points in time on the t axis of each of the curves 140 and 142.

Figure 5:
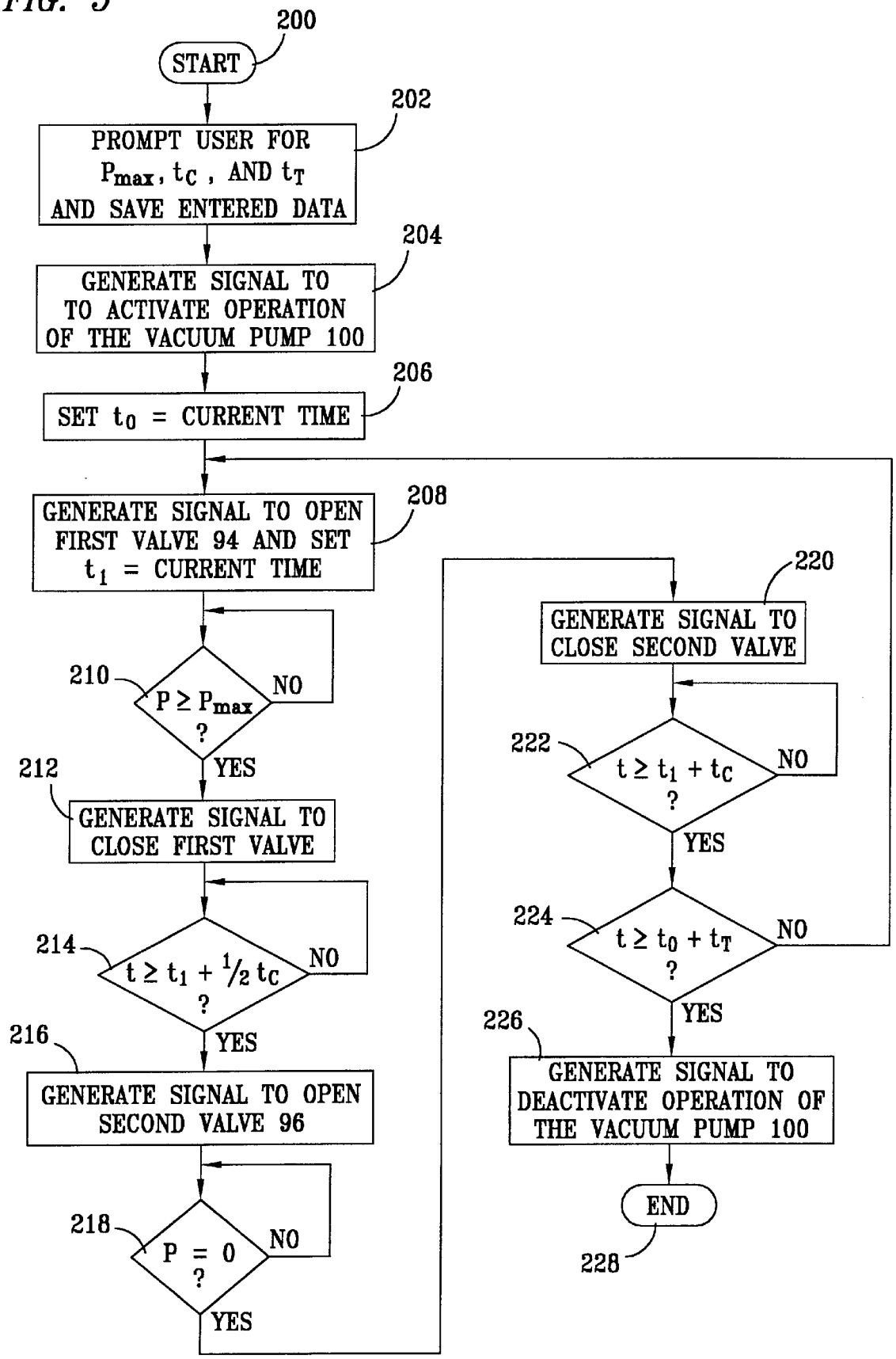
FIG. 5 is a flowchart illustrating control logic for operating the system of FIG. 1 in accordance with the present invention.

FIG. 5 is a flowchart of control logic implemented by the control program stored in the memory of the computer 12 for operating the system 10 (FIG. 1), in accordance with the present invention, on a selected portion of a user's body, such as the body 44 exemplified in FIG. 1. In step 200, the system is powered up and, in step 202, the computer 12 prompts the user for information, described below, required in the operation of the system 10. Upon receipt of the information prompted for, the information is stored in the memory of the computer 12. Such information includes the maximum vacuum pressure $P_{max}$ that is to be pulled by the system 10, the cycle time $t_C$ through which a vacuum should be pulled and then released, and the treatment time $t_T$ that the system 10 should be applied to the selected portion of the user's body. The values of $P_{max}$, $t_C$, and $t_T$ may be determined based on a number of factors which may also be stored in the memory of the computer 12, such as past treatment performed on the body of the user, the medical history of the user, the selected portion of the user's body to be treated, what is desired to be achieved by treatment, and the like. For example, it has been found that, generally, fatty tissue may be removed by using cycles times, $t_C$, of from about 2 seconds to about 10 seconds, and typically from about 3 seconds to about 6 seconds, and preferably about 4 seconds, wherein a vacuum pressure is applied during approximately half of the cycle time. Furthermore, it has been found that, generally, the size of organs such as a breast or penis, may be enhanced by using longer cycles times, $t_C$, generally ranging from about 5 seconds to about 24 seconds, and typically from about 10 seconds to about 16 seconds, and preferably about 12 seconds, wherein a vacuum pressure is applied during approximately half of the cycle time, though the vacuum pressure may be applied for fractions of the cycle time other than one half of the cycle time. It has also been found that treatments are effective when administered for periods of time $t_T$ ranging from about 10 to about 60 minutes and, typically, from about 20 to about 45 minutes and, preferably, about 30 minutes. Effective vacuum pressures have been found to range from about 5 kPa of vacuum to about 40 kPa of vacuum, and typically from about 10 kPa of vacuum to about 30 kPa of vacuum, and preferably about 20 kPa of vacuum. Before proceeding to step 204, the third and fourth valves 110 and 130 (FIG. 3), respectively, must be adjusted using the valve stems 112 and 132, respectively, as desired. The degree to which the valves 110 and 130 are open directly effects the rapidity with which vacuum pressure is applied to or released from, respectively, the sealing device 40. For example, the pressure-time curve 140 was produced when the valves 110 and 130 were opened wider than they were when the pressure-time curve 142 was produced.

Upon execution of the foregoing step 202 and placement of the sealing device 40 onto the selected portion of the user's body, execution proceeds to step 204 in which the computer 12 (FIG. 1) generates a signal through the cables 22 and 76 (FIG. 3) to the microprocessor 80 in the vacuum pressure generator unit 20 to activate operation of the vacuum pump 100. In step 206, the variable to, depicted as a point in time on the t axis of the curves 140 and 142 shown in FIG. 4, is set to the current time available in a well-known manner from on a clock (not shown) mounted in the computer 12. In step 208, the computer 12 (FIG. 1) generates a signal through the cables 22 and 76 (FIG. 3) to the microprocessor 80 in the vacuum pressure generator unit 20 to cause the first actuator 90 to open and hold open the first valve 94. While the first valve 94 is held open, a vacuum is pulled by the pump 100 through the tube 106, the first valve 94, the tube 108, the third valve 110, the tube 114, the cross 116, the tube 118, the filter 120, the vacuum inlet 30, and the tube 36 to create a vacuum in the sealing device 40 which vacuum is applied to the selected portion of the user's body. The variable $t_1$ is set equal to time at which the computer 12 generates the foregoing signal to activate the first actuator 90 to open the first valve 94.

In step 210, the pressure sensor 126 (FIG. 3) senses the vacuum pressure "P" being pulled by the vacuum pump 100 on the selected portion of the user's body, as discussed above with respect to step 208. The pressure P is compared with the $P_{max}$ entered by the user into the computer 12 as discussed above with respect to step 202. If the pressure P sensed by the pressure sensor 126 is less than $P_{max}$, then step 210 is repeated. If the pressure P sensed by the pressure sensor 126 is equal to or greater than $P_{max}$, then execution proceeds to step 212, at a point $t_2$ in time on the t axis of the curves 140 and 142 shown in FIG. 4, at which time the computer 12 (FIG. 1) generates a signal through the cables 22 and 76 (FIG. 3) to the microprocessor 80 to cause the first actuator 90 to close the first valve 94 so that no additional vacuum pressure is pulled in the sealing device 40. If an excessive amount of vacuum pressure is pulled, then the safety pressure relief valve 122 relieves the vacuum pressure to a safe level, such as 30 kPa of vacuum pressure. While not shown, control logic may also be implemented which provides for vacuum pressure to be increased to $P_{max}$ if the sealing device 40 should fail to maintain an adequate seal and leak vacuum pressure.

In step 214, the current time t is compared with the sum of $t_1$, and one half of the cycle time $t_C$. If the current time t is less than the sum of $t_1$, and one half of the cycle time $t_C$, then the step 214 is repeated. During the period of time while a vacuum pressure is being pulled on the sealing device 40, the circulation of blood near the surface of the skin is enhanced resulting in a number of therapeutic effects, such as fat removal or breast enhancement, depending on the cycle time $t_C$ used, as discussed above with respect to step 202. If, in step 214, the current time t is greater than or equal to the sum of $t_1$ and one half of the cycle time $t_C$, then execution proceeds to step 216, at a point $t_3$ in time on the t axis of the curves 140 and 142 shown in FIG. 4, at which time the computer 12 (FIG. 1) generates a signal through the cables 22 and 76 (FIG. 3) to the microprocessor 80 to cause the second actuator 92 to open and hold open the second valve 96 so that atmospheric air enters through the pressure inlet 32, the valve 96, the tube 132, the fourth valve 130, the tube 128, the cross 116, the tube 118, the tube 36, and the sealing device 40, thereby relieving the vacuum pressure in the sealing device 40.

In step 218, the pressure sensor 126 (FIG. 3) senses the vacuum pressure "P" as it is released through the valve 96, as discussed above with respect to step 216. If the pressure P sensed by the pressure sensor 126 has not been released to a predetermined low vacuum pressure, such as zero (e.g., has not been released to atmospheric pressure), then step 218 is repeated. If the pressure P sensed by the pressure sensor 126 has been released to a predetermined low vacuum pressure, such as zero (e.g., has been released to atmospheric pressure), then execution proceeds to step 220, at a point $t_4$ in time on the t axis of the curves 140 and 142 shown in FIG. 4, at which time the computer 12 (FIG. 1) generates a signal through the cables 22 and 76 (FIG. 3) to the microprocessor 80 to cause the second actuator 92 to close the second valve 96.

In step 222, the current time t is compared with the sum of $t_1$ and the cycle time $t_C$. If the current time t is less than the sum of $t_1$ and the cycle time $t_C$, then the step 222 is repeated. If, in step 222, the current time t is greater than or equal to the sum of $t_1$and the cycle time $t_C$, then execution proceeds to step 224, at a point $t_4$ in time on the t axis of the curves 140 and 142 shown in FIG. 4.

In step 224, the current time t is compared with the sum of $t_0$ and the treatment time $t_T$. If the current time t is less than the sum of to and the treatment time $t_T$, then execution returns to step 208. If the current time t is equal to or greater than the sum of $t_0$ and the treatment time $t_T$, then execution proceeds to step 226, at a point $t_5$ in time on the t axis of the curves 140 and 142 shown in FIG. 4, at which time the computer 12 (FIG. 1) generates a signal through the cables 22 and 76 (FIG. 3) to the microprocessor 80 to deactivate the vacuum pump 100. Step 228 represents completion of a treatment on a user in accordance with the present invention.

It can be appreciated that steps 208 through 224 represent one cycle in the operation of the system 10, depicted on the curves 140 and 142 as $c_l$. While FIG. 4 shows two such cycles, depicted as $c_1$and $c_2$, on each curve, a treatment may comprise several hundred such cycles, ranging, for example, from about 100 to about 1,000 such cycles and, typically, from about 300 to about 700 such cycles and, preferably, about 500 such cycles.

By the use of the present invention shown in FIG. 1, a user may loose fat and/or enhance and/or heal selected portions of his/her body without diet, exercise, or expensive medicinal treatment, surgery, or chiropractic or massage therapy.

It is understood that the present invention can take many forms and embodiments. Accordingly, several variations may be made in the foregoing without departing from the spirit or the scope of the invention. For example, the system 10 may be configured to permit a trained operator to manually control when signals are generated by the computer 12 to the vacuum pressure generator unit 20, particularly the signals generated at the points in time depicted as $t_1$, $t_3$, and $t_5$ on the t axis of the curves 140 and 142 shown in FIG. 4 for applying and releasing vacuum pressure and terminating treatment.

Figure 6:
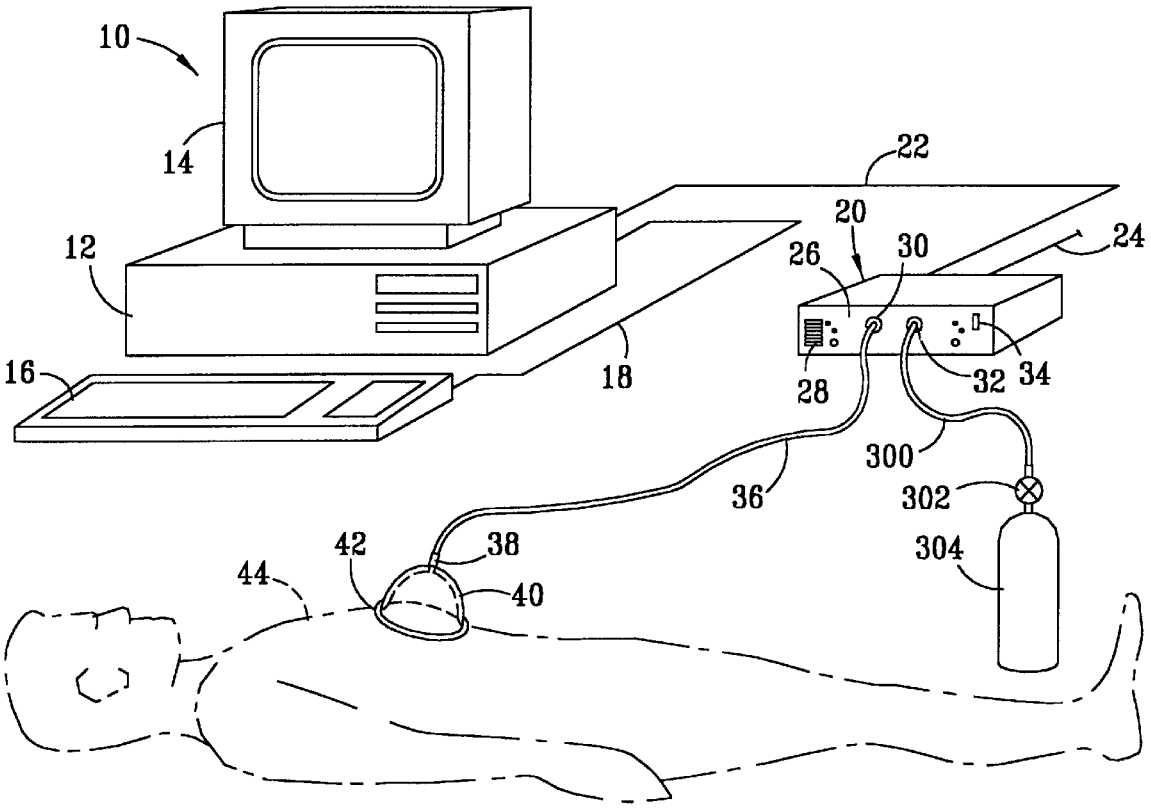
FIG. 6 shows an alternate embodiment of the present invention.

In another embodiment, a gas, other than air, such as oxygen, may be supplied to the pressure inlet 32 for enhancing the healing of open wounds on a user's skin. Such an embodiment is depicted in FIG. 6 in which the pressure inlet 32 is connected via a pneumatic tube 300 to a valve 302 on a tank 304 containing pressurized oxygen. The, when the vacuum pressure in the sealing device 40 is released as in step 216 above, the sealing device is filled with oxygen instead of air. The valve 302 may be replaced with a three-way valve or an arrangement of valves to permit either oxygen or air or a combination thereof to be released into the sealing device 40.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Accordingly, it is appropriate that the appended claims be construed broadly and in a manner consistent with the scope of the invention.

Having thus described the invention, what is claimed is:

1. A method for passively exercising a selected portion of a human body, the method comprising the steps of:

a) applying a partial vacuum pressure to the selected portion of the human body;

b) maintaining the partial vacuum pressure applied to the selected portion of the human body for a first predetermined period of time;

c) releasing the partial vacuum pressure so that substantially atmospheric pressure is applied to the selected portion of the human body;

d) maintaining the substantially atmospheric pressure applied to the selected portion of the human body for a second predetermined period of time; and e) cyclically repeating steps (a) through (d) to the selected portion of the human body.

2. The method of claim 1 wherein the step of cyclically repeating steps (a) through (d) is performed a preselected number of times.

3. The method of claim 1 wherein the selected portion of the human body is selected from a group consisting of fatty tissue, muscle tissue, a breast, a penis, a portion of a leg, a foot, a portion of an arm, an arm, a portion of a back, a healing portion of skin, and a wrinkled portion of skin.

4. The method of claim 1 wherein the step of applying a partial vacuum pressure further comprises sealing the selected portion of the human body to form a sealed portion of the human body to which the partial vacuum pressure may be applied and controlled.

5. The method of claim 1 wherein the step of applying a partial vacuum pressure further comprises sealing the selected portion of the human body with a sealing device to form a sealed portion of the human body to which pressure may be applied and controlled, and the step of releasing further comprises injecting substantially pure oxygen into the sealing device until the pressure in the sealing device is substantially atmospheric pressure.

6. The method of claim 1 wherein the step of applying a partial vacuum pressure further comprises sealing the selected portion of the human body with a sealing device to form a sealed portion of the human body to which pressure may be applied and controlled, and the step of releasing further comprises releasing atmospheric air into the sealing device until the pressure in the sealing device is substantially atmospheric pressure.

7. The method of claim 1 wherein the selected portion of the human body is a woman's breast, and the step of applying a partial vacuum pressure further comprises sealing off the breast so that a partial vacuum pressure may be applied to the breast and controlled to enhance the size of the breast.

8. The method of claim 1 wherein the selected portion of the human body is a woman's breast, and the step of applying a partial vacuum pressure further comprises sealing off the breast so that pressure may be applied to the breast and controlled, and wherein the first predetermined period of time and the second predetermined period of time are each from about 3 seconds to about 12 seconds, to enhance the size of the breast.

9. The method of claim 1 wherein the selected portion of the human body is fatty tissue, and the step of applying a partial vacuum pressure further comprises sealing off the fatty tissue so that a partial vacuum pressure may be applied to the fatty tissue and controlled to remove at least a portion of the fatty tissue.

10. The method of claim 1 wherein the selected portion of the human body is fatty tissue, and the step of applying a partial vacuum pressure further comprises sealing off the fatty tissue so that a partial vacuum pressure may be applied to the fatty tissue and controlled, and wherein the first predetermined period of time and the second predetermined period of time are each from about 1 second to about 5 seconds.

11. The method of claim 1 wherein the partial vacuum pressure is from about 5 kPa of vacuum to about 40 kPa of vacuum, and typically from about 10 kPa of vacuum to about 30 kPa of vacuum, and preferably about 20 kPa of vacuum.

12. The method of claim 1 wherein the first predetermined period of time and the second predetermined period of time are each from about 1 second to about 5 seconds, and typically from about 1.5 seconds to about 3 seconds, and preferably about 2 seconds.

13. The method of claim 1 wherein the first predetermined period of time and the second predetermined period of time are each from about 3 seconds to about 12 seconds, and typically from about 5 seconds to about 8 seconds, and preferably about 6 seconds.

14. The method of claim 1 wherein at least ten minutes elapse during the time that the steps (a) through (d) are cyclically repeated.

15. The method of claim 1 wherein the step of cyclically repeating the steps (a) through (d) is performed at least twice per minute.

16. The method of claim 1 wherein the step of applying a partial vacuum pressure is performed using an eletrically powered pump.

17. A system for passively exercising a selected portion of a human body, the system comprising:

a) a pump configured for generating a partial vacuum pressure;

b) a first valve connected in fluid communication with an output of the pump;

c) a second valve in fluid communication with atmospheric pressure;

d) a sealing device configured for providing a pressure seal over the selected portion of the human body, the sealing device being connected in fluid communication with the first valve so that when the first valve is open, fluid communication is established between the sealing device and the output of the pump, the sealing device being connected in fluid communication with the second valve so that when the second valve is open, fluid communication is established between the sealing device and atmospheric pressure; and e) a controller configured for controlling the opening and closing of the first valve and the second valve in response to signals received from a computer.

18. The system of claim 17 further comprising a third valve connected in series with the first valve between the sealing device and the pump, the third valve being configured for being operable in a partially open state for controlling the rate of fluid flow through the first valve, and a fourth valve connected in series with the second valve between the sealing device and atmospheric pressure, the third valve being configured for being operable in a partially open state for controlling the rate of fluid flow through the second valve.

19. The system of claim 17 further comprising a safety valve in fluid communication with the sealing device for automatically releasing pressure in the sealing device to atmospheric pressure when the pressure in the sealing device exceeds a predetermined vacuum pressure.

20. The system of claim 17 wherein the sealing device is configured for sealing a portion of a human body selected from the group consisting of fatty tissue, muscle tissue, a breast, a penis, a portion of a leg, a foot, a portion of an arm, a hand, a portion of a back, a healing portion of skin, and a wrinkled portion of skin.

21. The system of claim 17 further comprising a source of substantially pure oxygen, the source having a outlet in fluid communication with the second valve for permitting the oxygen to pass into the sealing device when the pressure in the sealing device is released to atmospheric pressure.

22. The system of claim 17 wherein the pump is an electrically powered pump.

23. A method for passively exercising a selected portion of a human body, the method comprising the steps of:

a) applying a first absolute pressure to the selected portion of the human body, the first absolute pressure being less than atmospheric pressure;

b) maintaining the first absolute pressure applied to the selected portion of the human body for a first predetermined period of time;

c) releasing the pressure applied to the selected portion of the human body to a second absolute pressure greater than the first absolute pressure;

d) maintaining the second absolute pressure applied to the selected portion of the human body for a second predetermined period of time; and e) cyclically repeating steps (a) through (d) to the selected portion of the human body.

24. The method of claim 23 wherein the first absolute pressure is a partial vacuum pressure and the second absolute pressure is substantially atmospheric pressure.

25. The method of claim 23 wherein the first absolute pressure is a partial vacuum pressure and the second absolute pressure is non-atmospheric pressure.

26. The method of claim 23 wherein the step of cyclically repeating the steps (a) through (d) is performed at least twice per minute.

27. The method of claim 23 wherein the step of applying a first absolute pressure is performed using an electrically powered pump.

* * * * *

UNITED STATES PATENT AND TRADEMARK OFFICE

CERTIFICATE OF CORRECTION

PATENT NO. : 6,030,318
DATED : February 29, 2000
INVENTOR(S) : Howard, Kenneth W.

It is certified that error appears in the above-identified patent and that said Letters Patent is hereby corrected as shown below:

Column 6,
Line 3, delete "to" insert -- $t_0$ --

Column 7,
Line 20, delete "to" insert -- $t_0$ --

Column 9,
Lines 22-24, delete ", and typically from about 1.5 seconds to about 3 seconds, and preferably about 2 seconds"
Lines 27-29, delete ", and typically from about 5 seconds to about 8 seconds, and preferably about 6 seconds"
Line 37, delete "eletrically" insert -- electrically --

Signed and Sealed this

Twenty-fourth Day of June, 2003

JAMES E. ROGAN
*Director of the United States Patent and Trademark Office*